US005114766A

United States Patent [19]

Jacques

[11] Patent Number: 5,114,766

[45] Date of Patent: May 19, 1992

[54] CONTAINER PROVIDED WITH A MULTILAYER COVER WITH VENTING PROVISIONS AND RELATED METHOD

[76] Inventor: Pierre J. Jacques, 10 Coptor Ct., Huntington, N.Y. 11743

[21] Appl. No.: 553,167

[22] Filed: Jul. 13, 1990

[51] Int. Cl.[5] ..... B65B 25/22; B65D 51/16; B65D 65/10

[52] U.S. Cl. ..... 428/35.7; 428/43; 428/136; 426/107; 426/113; 206/484.2; 220/203; 220/209; 220/360

[58] Field of Search ..... 426/234, 395, 521, 396, 426/412, 107, 113; 206/484, 484.2, 524.2; 428/35.7, 480, 483, 43, 136, 341, 340, 216; 220/209, 203, 360, 363, 366

[56] References Cited

U.S. PATENT DOCUMENTS

| | | | |
|---|---|---|---|
| 3,997,677 | 12/1976 | Hirsch et al. | 426/113 |
| 4,141,487 | 2/1979 | Faust et al. | 229/43 |
| 4,210,674 | 7/1980 | Mitchell | 426/107 |
| 4,404,241 | 9/1983 | Mueller et al. | 428/138 |
| 4,419,373 | 12/1983 | Oppermann | 426/234 |
| 4,530,440 | 7/1985 | Leong | 220/201 |

*Primary Examiner*—Ellis P. Robinson
*Assistant Examiner*—Charles R. Nold
*Attorney, Agent, or Firm*—Ladas & Parry

[57] ABSTRACT

A package is provided which includes a container having a chamber and provided with an opening which is closed by a multi-layered sheet. The multi-layered sheet is coupled to the container in hermetically sealed relation. The multi-layer sheet includes first and second layers in face-to-face relationship and cooperatively melded to the edge portion of the container. The first layer is adjacent to the container and obturates the opening of the container. The second layer is provided with a slit arrangement defining at least one displaceable flap. The first layer is imperforate and is relatively thin. It responds to a buildup of pressure within the container to rupture and displace the flap in order to vent the container. A third layer is further provided which is connected in face-to-face relationship with the second layer and which is also provided with the aforementioned slit arrangement. The third layer is relatively heat resistant and shape retentive and includes at least one flap in registration with the aforementioned flap. The slit arrangement is, for example, H-shaped, but may also be Z-shaped or U-shaped. Preferably, the first layer is maintained in detached relationship to the second layer in an area encompassing the slit arrangement. The first and third layers are relatively thin in comparison with the second layer.

18 Claims, 1 Drawing Sheet

CONTAINER PROVIDED WITH A MULTILAYER COVER WITH VENTING PROVISIONS AND RELATED METHOD

FIELD OF INVENTION

This invention relates to multilayer sheets for closing containers and more particularly to containers provided with venting arrangements to prevent pressure buildup during heatings such as by microwave ovens and the like. The invention also relates to methods of constructing such containers with appropriate covers therefor.

BACKGROUND

Many foods are sold in containers which require the removal of the lids thereof to prevent an explosion of their contents during a heating process. In some cases, it is necessary to strike holes into the lid of the container before heating the contents thereof. Still other arrangements supply a secondary lid which is used after the removal of a primary lid.

Various U.S. Patents are available which disclose structures for sealed packages especially useful in connection with microwave ovens and the like. These patents include U.S. Pat. Nos. 3,997,677; 4,141,487; 4,210,674; and 4,404,241.

In U.S. Pat. No. 3,997,677 Arthur Hirsh et al disclose a package capable of withstanding prolonged exposure to relatively high temperatures. The package is formed from a composite film which includes a thermostable, thermoplastic layer and a polyolefin layer having a relatively low softening point. The package is a hermetically sealed construction which includes a weakened seal area which acts as a pressure release valve and which may be employed as a serving dish as well as a heating container.

Clifford Faust et al disclose in U.S. Pat. No. 4,141,487 a disposable package having an upper layer composed of a thin film plastic material, having a sealed, pleated section extending from opposite parallel sides intermediate the ends thereof and an elongated vent disposed within the pleated section. The sealed, pleated section is adapted to open and expose a vent at a predetermined temperature below the cooking temperature of the product.

In U.S. Pat. No. 4,210,674, Richard Mitchell discloses a paperboard tray covered by a plastic film bonded to upper edges of the tray sidewalls. The film provides a barrier against contamination of the food therein. The film and tray are transparent to micro-wave energy for heating the food and automatic venting of the covered tray while heating is afforded by a relatively small strip of electrically conductive material on the film. This material is absorptive of micro-wave energy in an amount sufficient to melt a vent opening in the film.

In U.S. Pat. No. 4,404,241, Robert Mueller et al disclose a multilayered heat material and a package involving the use of the same. The materials have apertures sealed with an extrudable hot melt material which conveys moisture barrier properties and is adapted to soften and permit venting of vapor generated in the package prior to distortion of the seam. The Mueller construction depends upon an extremely low sealing melt to soften and blow open heated vent opening. The material itself seals the associated hole and therefore possesses barrier properties.

SUMMARY OF INVENTION

It is an object of the invention to provide an improved container sealing material having provisions for venting heated containers.

It is a further object of the invention to provide an improved method for the formation of containers having a covering which provides for venting under conditions of elevated temperature and pressure.

Yet another object of the invention is to provide an improved container having venting provisions effective in a relatively short period of time.

Still another object of the invention is to provide an improved venting arrangement which permits a response in a relatively short period of time according to pressure exerted thereupon.

Yet another object of the invention is to provide an improved multilayer material which permits the covering of containers while providing for a strong seal at the container edges.

Still another object of the invention is to provide for a particularly advantageous covering material which avoids leaks along the sides of containers.

In achieving the above and other objects of the invention, there is provided a package which comprises a container provided in turn with an opening and including a peripheral edge portion encircling the opening, and a multilayer sheet coupled to the edge portion in hermetically sealed relation. The sheet includes first and second layers in face-to-face relationship and cooperatively melded to the edge portion. The first layer is adjacent to the container and obturates the above-noted opening. The second layer is provided with a slit arrangement defining at least one displaceable flap. The first layer is relatively thin and is responsive to a buildup of pressure within the container to rupture and displace the flap whereby to vent the container.

According to further features of the invention, the layers include faces which are connected together, except in an area encompassing the slit arrangement. According to another feature of the invention, there is provided a third layer connected in face-to-face relationship with the second layer. The third layer is provided with the same slit arrangement. Moreover the third layer is relatively heat resistant and shape retentive. It includes at least one flap in registration with the first mentioned flap and displaceable therewith.

According to a further feature of the invention, the slit is preferably H-shaped. It may also be V-shaped or Y-shaped or U-shaped. The slit arrangement may preferably have a width in order of magnitude of 1 inch and a height in the order of magnitude of ¾ of an inch. These dimensions are particularly applicable to the H-shaped slit arrangement.

The area mentioned above, whereat the first and second layers are in the detached relationship, is preferably generally circular and has a diameter in the order of magnitude of 1¼ to 1¾ inches. The first and second layers are preferably of the same material which is sealable to the container. The first and third layers are generally of the same thickness with the second intermediate layer being substantially thicker.

In accordance with the method of the invention, there are comprised the steps of coupling two films in face-to-face relationship and slitting the thusly resulting lamination therethrough to form at least one displaceable flap, adding an imperforate film to the lamination in face-to-face relationship therewith, and sealing the imperforate film to a container to close the same. The method further comprises heating the container to build up pressure therein, to burst the imperforate film thereby to displace the aforementioned flap and thus vent the associated container.

Other objects, features and advantages of the invention will become apparent from the following detailed description of some preferred embodiments thereof as illustrated in the accompanying drawing.

DETAILED DESCRIPTION OF INVENTION

Figure 1:
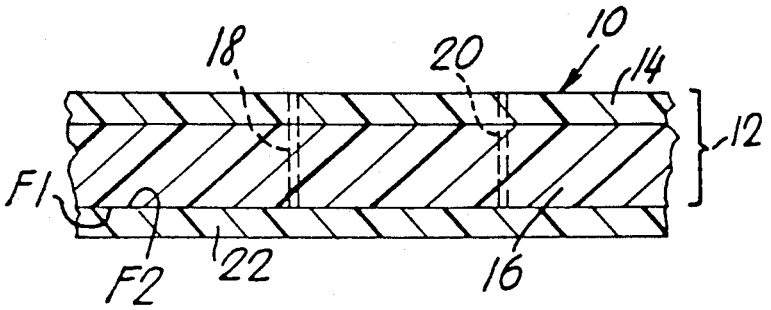
FIG. 1 is a side view, in section, illustrating a fragmentary portion of a lamination employed to cover a container in accordance with the invention.

This invention provides a lidding material made of layers which material is preferably heat sealed or otherwise affixed to a container which contains a prepared food or other item requiring heating in a conventional oven or microwave oven. The layers are constructed such as to include a heat resistant carrying layer which is, for example, made from paper or plastic or a combination of both. The inside layer is the heat sealing layer and is laminated or coated onto the carrying layer. The heat sealing layer is heat sensitive and is applied as a thin layer which is preferably less than one-half of a mil in thickness. The carrying or heat resistant layer is treated before the laminating or coating process by introducing slits therein.

The heat sealing layer or inside layer effectively closes the cuts or slits and hermetically seals them. However, during the heating process, the heat and pressure attack this layer and, without the supporting contiguous layer behind it at the slits, the thin layer ruptures at the slits. This then vents the container. More than one vent may be used on a container to aid in evacuating the container as required.

A preferred method of manufacture includes forming a plastic coated support sheet which is then coated with a compatible plastic heat seal coating the nature of which is determined by the container material. During the heat seal process, the thin heat sealing layer melts or blends into the support layer forming a stronger seal than otherwise could have been expected from this thin layer. The plastic coating on the support layer is cut in one of the various patterns along with the support or carrying layer. At the vent area, the only contiguous layer is this thin heat sealing layer, which will rupture when required.

The container material will govern the heat seal material required. For example, a polyethylene coated paper board could be lidded with a paper polyethylene combination such as: 25# Bleached Mg/1 mil Polyethylene/4# polyethylene. Polyester film can be substituted for the paper and adhesively laminated to 1.5 mil poly film.

This would be satisfactory for most polyethylene based containers, or those using polyethylene as a coating on paperboard or another plastic. This would also apply to co-extruded containers which use polyethylene as the inner layer.

For a PET container, a PET copolymer would be used as the heat seal layer and would also be used for the lamination layer with polyester being the carrying layer.

The shape of the cuts or the slits may be an elongated "V" or "U" with a rounded point. The length would preferably be one inch and the width at the top of the "V" or the widest point would be less than one-half of an inch. This allows for a "peeling back" motion of the thusly defined flap during the venting process. When random vents are necessary, vents of a magnitude such as $\frac{1}{4}'' \times \frac{3}{8}''$ would be preferred. H-shaped slit arrangements are, however, preferred as discussed before.

Registration is possible when the lid material is printed during the processing of the carrying layer. Printed instructions can be included. The location of each vent can be marked by the print design. A register mark can be provided for proper application of the lid to the associated container.

Another feature of the slit arrangement is that it can be used in a method for opening the lid by the use of a lever or folded piece of paperboard that might be part of the outer package.

Another feature of the invention, where more package integrity is required, is the incorporation of an expandible ink between the layers. This is registered onto one of the slits and the other layer is also cut, but with a slit which is not in line with the cut in the first slit layer. Heat causes the special ink to expand, rupturing the lamination, and forming a channel between the slit in the first layer and the cut in the second layer.

Another concept of this invention is a method to determine if the container has been previously heated. Inasmuch as the cover no longer has to be removed to heat the container, it would be desirable to determine if the item had been previously heated and vented and then not consumed. This could be accomplished by the use of the same expandible ink. The vent lid stock would preferably be printed with instructions and these would include a warning concerning previously heated containers if the ink were raised in a certain area.

In accordance with the invention a very thin film is laminated to an initial lamination which has been previously cut. There is no open hole on the top or carrier sheet layer. The subsequent lamination on the thin film tacks this cut or slit closed resulting in little or no barrier loss. The thinness of the imperforate layer is what allows the vent to rupture with heat and pressure. In addition its compatibility with the adjacent layer of the initial lamination allows for a strong seal at the container edge portion.

The very soft material that is utilized in the prior art softens at the seal area and can result in very weak seals with leaks on the side especially if there is a concentration of heat at any one point in a package.

The invention utilizes a low melt index material which has a higher softening point and which, when melded with the primary lamination at the heat seal area, forms an extremely strong seal. This forces the vent to be the weakest point in the entire lid. A film with a melt index of 2.0 (ASTM D 1238) is recommented along with a density in the order of magnitude of 0.912 grams/cm$^3$ (ASTM-D-1505).

Testing has shown that the shape of the cut is critical. Although V-shaped and U-shaped slits have already been mentioned, an H-shaped cut or slit performed best when cut to a width of one inch with a three-quarters of an inch height. A cut of larger dimensions was satisfactory for blow-out purposes, but the larger the cut the greater the chance of barrier loss. On the other hand, a smaller cut of one-half of an inch did not weaken until two and one-half minutes cooking at high temperature. This resulted in too high a pressure build up.

The lamination of choice is 48 gauge polyester laminated to 1.5 mil low-density polyethylene laminated to 0.5 mil polyethylene. This combination with a one-inch H-shaped cut blew out after one minute at a high temperature setting.

From tests it was found out that the V-shaped cuts did not perform as well as the H-shaped cuts. While the H-shaped cuts worked well, U-shaped and Y-shaped cuts did not evacuate as quickly. On the H-shaped cut, it made little difference whether the H-shaped cuts were in the machine or cross-machine direction of the film.

It was also found that a minimum or no bond in the vent or cut areas facilitated the vent or flap actuation. This can be accomplished with the use of a press-laminator combination. The cut and print identifying the vent and a registered adhesive are applied simultaneously during the second lamination phase. Minimum or no adhesive is placed in the vent area to guarantee minimum bond. This is accomplished by registering the adhesive on a press/laminator.

The microwave container is normally made from solid bleached sulfite (SBS) board which has been poly coated for water proofing. Consequently, the poly film used in the lid described above heat seals satisfactorily to the container.

Some containers are made from paper board such as a 12 point or 120 mil solid bleached sulfite which is coated with extruded polyethylene terephthalate or polypropylene. In this case, either a film lid as previously described or a board lid as described above can be utilized.

Other containers utilize coatings and plastics such as PET, CPET, polypropylene, high density polyethylene, etc. The lid lamination can be made from any compatible plastic as long as the basic concept is maintained. Specifically, a thin film or coating over a similar or compatible plastic is used to insure melding at the seal area and a feature is employed to permit the inside coating or film to be loosely applied over the vent area. In the case of a lamination, this would mean not applying adhesive in this area. In the case of an extrusion coating, this would require an application of a non-compatible coating registered in the vent area. For example, a saran or nitrocellulose coating can be used as it is not compatible with polyethylene. This coating is positioned at the same time as the printing and cutting is effected on a press and thus can be done is register.

An alternative method of manufacture utilizes a lamination of paperboard and polyethylene terephthalate extruded thereon. An inner extrusion or polyethylene terephthalate is then applied. This is used when a rigid lid or top for the container is preferred. The structure performs in the same manner as described heretofore.

Referring to the drawing, FIG. 1 illustrates a fragmentary portion of a lamination 10 provided in accordance with the invention. Therein included an initial lamination 12 consisting of a layer 14 and a layer 16. These two layers are initially laminated together and pre-cut in one of the forms mentioned hereinabove as illustrated by way of example at 18 and 20. Layer 14 is a heat-resistant, shape retentive, carry layer, which may be for example 48 g PET. Its function is to support the balance of the overall lamination and to retain heat during high temperature processing of the lamination 10 during the preparation thereof.

Also included in the lamination 10 is a further layer 22. This layer is the sealant layer which is preferably of a thickness in the order of magnitude of 0.5 mils. It is preferably polyethylene film, the function of which is to constitute a sealant layer, which is melded or sealed to the edge portions of the container which is to be closed in order to obturate the opening into the inner chamber of the container.

The layer 16 is a compatible layer preferably made of the same material as the sealant layer 22. The layer 14 and the layer 22 are preferably of the same order of magnitude of thickness, namely the order of magnitude of about 0.5 mils thickness. The middle layer 16 is approximately three times the thickness of the outer layers 14 and 22 and in the preferred embodiment is in the order of magnitude of about 1.5 mils. This middle layer, being the same material as layer 22 is preferably of polyethylene film. The shape retaining layer 14 is preferably of polyethylene teraphthalate.

Figure 2:
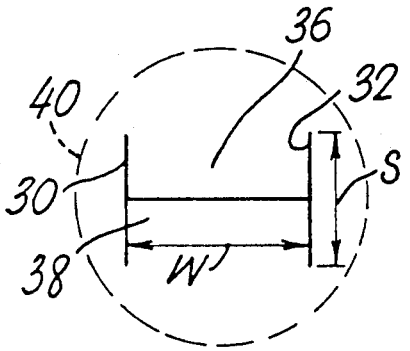
FIG. 2 is a diagrammatic illustration of a slit arrangement employed to provide a vent in accordance with the invention.

FIG. 2 illustrates the shape of the preferred slit arrangement which as indicated above is H-shaped. It consists of legs 30 and 32 having a cross-bar 34, thus forming two flaps 36 and 38, which under appropriate temperatuer and pressure conditions are forced open by the bursting or rupturing of the layer 22 (see FIG. 1). The width W illustrated in FIG. 2 is preferably in the order of magnitude of about one inch. The height S of the slit arrangement is preferably in the order of magnitude of three-quarters an inch. Thus, for example, the width W may be one inch, plus three-eigths of an inch to minus one-eighth of an inch, while the height S may be, for example, three-quarters of an inch minus one-sixteenth of an inch to plus one-eighth of an inch.

As has been mentioned hereinabove, the attached faces of layers 16 and 22 (illustrated, for example, at F1 and F2 are maintained in detached relationship in the vicinity of the slit arrangement described hereinabove. This detached area may, for example, be circular as indicated at 40. Preferably, for example, this circular, unattached area will have a diameter for the dimensions indicated above in a range having an order of magnitude of, for example, about one and one-quarter to one and three-quarter inches.

Figure 3:
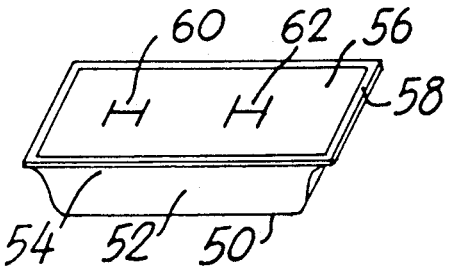
FIG. 3 is a diagrammatic perspective view of a container provided with a cover embodying venting arrangements in accordance with the invention.

FIG. 3 illustrates a container 510 having sides 52 with upper edge portions 54. Container 50 is covered by lidding or lid material 56 formed in a lamination as has been desribed above. The heat sealed perimetral portions are indicated are indicated at 58. The lid material in the illustrated environment is provided with two slit arrangements 60 and 62.

Figure 4:
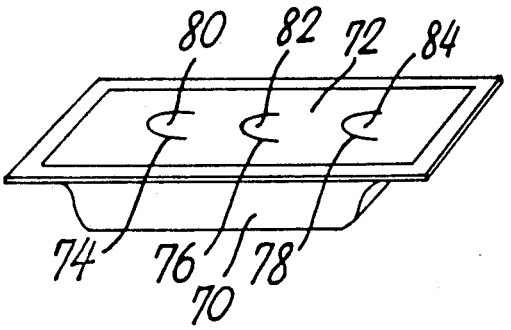
FIG. 4 is a view similar to FIG. 3 illustrating a different venting arrangement.

FIG. 4 illustrates a container 70 formed with lidding 72 provided with three V-shaped or U-shaped slitting arrangements 74, 76 and 78. As with the H-shaped slit arrangements flaps are formed as indicated at 80, 82 and 84. These flaps are forces upwardly to provide a venting arrangement upon the rupturing of the sealant layer under appropriate conditions of heat and pressure developing in the interior of the container during a processing in a microwave oven or the like.

The following chart illustrates a number of material combinations which are effective to provide the benefits of the invention. Therefrom it is seen that the layer 14 is preferably of polyethylene terephthalate, whereas the layer 16 is preferably fabricated of polyethylene, copolymerized polyethylene terephthalate, ethylene vinyl acetate, or ethylene propylene copolymer. The layer 22 is preferably fabricated of a plastic from the group consisting of polyethylene film, polyethylene coating, ethylene vinyl acetate film ethylene vinyl acetate coating, ethylene propylene copolymer film and ethylene propylene copolymer coating. The adhesive coating enabling the attachment of the various layers is preferably chosen from the following adhesives: ethylene/imine copolymer, polyvinylidine chloride, nitrocellulose, or ethylene propylene copolymer emulsion. The non-compatible substance mentioned hereinabove with respect to area 40 (see FIG. 2) is preferably of saran or nitrocellulose and the container may preferably be of solid bleached sulfite board coated with polyethylene, although other conventional containers are possible, as long as they are fabricated of a material compatible with layers 16 and 22, or are provided with coatings which have this compatibility.

| CONTAINERS | LID LAMINATION | SEAL LAYER | ADHESIVE COATING |
|---|---|---|---|
| SBS/Polyethylene | PET/Polyethylene | PE Film | Ethylene/Imine |
| | | PE CTG | PVDC |
| SBS/Polyester | PET/CPET | PET Copolymer CTG | PVDC |
| Polyester Copolymer | PET/CPET | PET Copolymer | PVDC |
| High Density | PET/PE-EVA | EVA Film | E-Imine |
| Polyethylene | | EVE-CTG | Nitrocellulose |
| SBS/Polypropylene | PET/EP/Copolymer | EP Copolymer Film | EP Copolymer Emulsion |
| | | EP Copolymer CTG | PVDC |
| Polypropylene | PET/EP Copolymer | EP Copolymer Film | EP Copolymer Emulsion |
| | | EP Copolymer CTG | PVDC |
| SBS/PETX | SBS/PETX | CPET CTG | PVDC |
| | | EAA CTG | PVDC |
| SBS/PETX | PET/CPET | CPET CTG | PVDC |
| | | EAA CTG | PVDC |

CPET Copolymer of polyethylene terephthalate
PET Polyethylene terephthalate
PETX Polyethylene terephthalate extrusion
CTG Coating
SBS Solid bleached sulfite paperboard
EAA Ethylene acrylic acid copolymer
EVA Ethylic vinyl acetate copolymer
PVDC Polyvinylidadine Chloride The method of the invention includes the steps of coupling two films in face-to-face relation and slitting the thusly resulting initial lamination therethrough to form at least one displaceable flap, adding an imperforate film to the lamination in face-to-face relationship therewith, and sealing the imperforate film to a container to close the same. The heating of the container and the contents thereof a build up pressure within the container operates to burst the imperforate film due to the thinness thereof to displace the flap and vent the container.

There will now be obvious to those skilled in the art many modifications and variations of the construction and method set forth hereinabove. These modifications and variations will not depart from the scope of the invention, if defined by the following claims.

What is claimed is:

1. A package comprising a container provided with an opening and including a peripheral edge portion encircling said opening, and a multilayer sheet coupled to said edge portion in hermetically sealed relation, said sheet including first and second layers connected in face-to-face relationship with said first layer being heat sensitive and melded to said edge portion, said first layer being adjacent said container and obturating said opening, said second layer being provided with a slit arrangement defining at least one displaceable flap, said first layer sealing the slit arrangement but being relatively thin and responsive to a buildup of pressure within said container to rupture in correspondence with said slit arrangement and displace said flap whereby to vent said container, the first and second layers including faces which are connected together except in an area encompassing said slit arrangement, said package further comprising a third layer connected in face-to-face relation with said second layer and also provided with said slit arrangement; said third layer being relatively heat resistant and shape retentive, said third layer including at least one flap in registration with the first said flap displaceable therewith, said first and third layers being on opposite faces of said second layer, said first layer being maintained in position by said second and third layers.

2. A packaged as claimed in claim 1 wherein said slit arrangement is H-shaped.

3. A package as claimed in claim 1 wherein said slit arrangement is V-shaped, Y-shaped or U-shaped.

4. A package as claimed in claim 2 wherein the slit arrangement has a width in the order of magnitude of one inch and a height in the order of magnitude of three-quarters of an inch.

5. A package as claimed in claim 4, wherein said area is generally circular and has a diameter in the order of magnitude of about one and one-quarter to one and three-quarters inches.

6. A package as claimed in claim wherein said area is generally circular and has s diameter in the order of magnitude of about one and one-quarter to one and three-quarters inches.

7. A package is claimed in claim 1 wherein said first and second layers are of the same material which is sealable to said container.

8. A package as claimed in claim 1 wherein said first and third layers are generally of the same thickness and said second layer is substantially thicker.

9. A package as claimed in claim 8 wherein said first and third layers are each in the order of magnitude of about one-half a mil thick and the second layer is in the order of magnitude of about one and one-half mils thick.

10. A package as claimed in claim 1 wherein the third layer is polyethylene terephthalate.

11. A package as claimed in claim 1 wherein the second layer is selected from the group consisting of polyethylene, copolymerized polyethylene terephthalate, ethyl vinyl acetate, and ethylene propylene copolymer.

12. A package as claimed in claim 3 wherein the first layer includes a plastic selected from the group consisting of polyethylene film, polyethylene coating, ethylene vinyl acetate film, ethylene vinyl acetate coating, ethylene propylene copolymer film, ethylene propylene copolymer coating, polyethylene thixophthalate copolymer coating and ethyl acrylic acid copolymer coating.

13. A package as claimed in claim 1 wherein the first layer has a melt index in the order of magnitude of about two.

14. A package as claimed in claim 13 wherein the first layer has a density in the order of magnitude of about 0.9 grams/cubic cm.

15. A package as claimed in claim 1 wherein the slit arrangement is V- or U-shaped with a length and width in the order of magnitude of about one inch and one-half inch, respectively.

16. A package as claimed in claim 1 comprising a non-compatible substance between the first and second layers in correpondence with said area.

17. A package as claimed in claim 16 wherein the non-compatible substance is saran or nitrocellulose.

18. A package as claimed in claim 1 wherein the container is of solid bleached sulphite board coated with polyethylene.

* * * * *